US008509642B2

(12) United States Patent
Kitami

(10) Patent No.: US 8,509,642 B2
(45) Date of Patent: Aug. 13, 2013

(54) FIXING APPARATUS AND IMAGE FORMING APPARATUS

(75) Inventor: Kenji Kitami, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 172 days.

(21) Appl. No.: 13/155,851

(22) Filed: Jun. 8, 2011

(65) Prior Publication Data

US 2011/0305476 A1 Dec. 15, 2011

(30) Foreign Application Priority Data

Jun. 9, 2010 (JP) ..... 2010-132039

(51) Int. Cl.
*G03G 15/20* (2006.01)

(52) U.S. Cl.
USPC ..... 399/69; 399/329

(58) Field of Classification Search
USPC ..... 399/67, 69, 70, 329
See application file for complete search history.

(56) References Cited

U.S. PATENT DOCUMENTS 5,758,228 A * 5/1998 Hirose et al. ..... 399/70
7,466,950 B2 * 12/2008 Matsuura et al. ..... 399/328
2003/0021616 A1 * 1/2003 Yoda et al. ..... 399/329
2006/0165449 A1 7/2006 Ito et al.
2007/0140719 A1 6/2007 Sato

FOREIGN PATENT DOCUMENTS

JP 2001-142350 5/2001
JP 2006-243029 9/2006
JP 2007-108686 4/2007
JP 2009-229872 10/2009

* cited by examiner

*Primary Examiner* — Walter L Lindsay, Jr.
*Assistant Examiner* — Barnabas Fekete
(74) *Attorney, Agent, or Firm* — Nixon & Vanderhye P.C.

(57) ABSTRACT

A fixing apparatus includes a hot roller, a fixing roller, a fixing belt that extends between the fixing roller and the hot roller and revolves, a pressure roller that is pressed against the fixing roller via the fixing belt, and forms a nip region between the pressure roller and the fixing belt, and at least one non-contact temperature sensor that detects a temperature of the fixing belt. A first temperature detection portion is set in a region where the fixing belt is in contact with a circumferential surface of the hot roller. A second temperature detection portion is set in a region that is on a downstream side in a revolution direction of the fixing belt relative to a point at which the fixing belt separates from the circumferential surface of the hot roller, and that is on an upstream side in the revolution direction relative to the nip region.

5 Claims, 10 Drawing Sheets

FIXING APPARATUS AND IMAGE FORMING APPARATUS

CROSS-REFERENCE TO RELATED APPLICATION

This application claims priority under 35 U.S.C. §119(a) on Patent Application No. 2010-132039 filed in Japan on Jun. 9, 2010, the entire contents of which are herein incorporated by reference.

BACKGROUND OF THE INVENTION

1. Field of the Invention

The present invention relates to a fixing apparatus that is applied in an electrophotographic image forming apparatus such as a copying machine, a facsimile machine, or a printer, and an image forming apparatus including the same.

2. Description of the Related Art

A fixing apparatus of this type is applied in an image forming apparatus that uses an electrophotographic method, an electrostatic recording method, a magneto-photographic method, or the like. Such a fixing apparatus heats and presses a recording sheet (such as plain paper, electrostatic recording paper, or photographic paper) onto which a toner image has been transferred, with the recording sheet sandwiched between a pair of fixing rotation members (belt, roller), and thereby fixes the toner image on the recording sheet.

For example, in fixing apparatuses as shown in FIGS. 8 to 11, an endless fixing belt 103 extends between a fixing roller 101 and a hot roller 102, the fixing roller 101 and a pressure roller 104 are pressed against each other via the fixing belt 103, and a nip region N is formed between the fixing belt 103 and the pressure roller 104. In such fixing apparatuses, the fixing roller 101, the hot roller 102, and the pressure roller 104 rotate, and the fixing belt 103 revolves. A recording sheet transported to the fixing apparatus passes through the nip region N, where the recording sheet is heated and pressed. The toner image on the recording sheet is thereby fixed.

In such fixing apparatuses, a non-contact temperature sensor (not shown) detects the surface temperature of the fixing belt 103, and a heater of the hot roller 102 is controlled based on this detected surface temperature, thereby adjusting the surface temperature of the fixing belt 103 in the nip region N, for instance.

For example, JP 2006-243029A (hereinafter, referred to as Patent Document 1) discloses a fixing apparatus that detects the surface temperature of the fixing belt using a non-contact temperature sensor, in a region E where the fixing belt 103 is in contact with the hot roller 102 (a region where the fixing belt faces the hot roller, the region being near where the fixing belt starts to wind around the hot roller) as shown in FIG. 8.

In the case where the surface temperature of the fixing belt 103 is detected in the region (see reference sign E in FIG. 8) where the fixing belt 103 is in contact with the hot roller 102, such as with the fixing apparatus shown in FIG. 8, the detected surface temperature of the fixing belt 103 approximately corresponds to the surface temperature of the hot roller 102. In a fixing apparatus such as shown in FIG. 8, the surface temperature of the fixing belt 103 changes due to the influence of ambient temperature at the same time as the fixing belt 103 separates from the hot roller 102 after revolving therearound. Specifically, even if the surface temperature of the fixing belt 103 that approximately corresponds to the surface temperature of the hot roller 102 is detected, the detected surface temperature greatly differs from the surface temperature of the fixing belt 103 in the nip region N. Accordingly, it is not possible to accurately adjust the surface temperature of the fixing belt 103 in the nip region N based on the detected surface temperature of the fixing belt 103.

In JP 2006-235604A (hereinafter, referred to as Patent Document 2) discloses a fixing apparatus that detects the surface temperature of the fixing belt using a non-contact temperature sensor, in a region G where the fixing belt 103 is in contact with the fixing roller 101 on the downstream side in the revolution direction of the fixing belt 103 (see the arrow in FIG. 9) relative to the nip region N, as shown in FIG. 9. Also, Patent Document 2 discloses a fixing apparatus that detects the surface temperature of the fixing belt using a non-contact temperature sensor, in a portion F (a region between the hot roller and the fixing roller) that is positioned on the upper portion of the upper and lower portions of the fixing belt that oppose to each other between the fixing roller 101 and the hot roller 102, as show in FIG. 10.

In the case where the surface temperature of the fixing belt 103 is detected on the downstream side in the revolution direction of the fixing belt 103 relative to the nip region N (see reference sign G in FIG. 9 and reference sign F in FIG. 10), such as with the fixing apparatuses shown in FIGS. 9 and 10, the detected surface temperature of the fixing belt 103 is the surface temperature after the revolving fixing belt has passed through the nip region N. In the fixing apparatuses as shown in FIGS. 9 and 10, the surface temperature of the fixing belt 103 gradually falls due to the influence of ambient temperature at the same time as the fixing belt 103 separates from the hot roller 102 after revolving therearound. Moreover, the surface temperature of the fixing belt 103 falls due to the heat of the fixing belt 103 being lost in the processing of fixing a toner image onto a recording sheet in the nip region N. Accordingly, in the case where the surface temperature of the fixing belt 103 is detected on the downstream side in the revolution direction of the fixing belt 103 relative to the nip region N, the detected surface temperature greatly differs from the surface temperature of the fixing belt 103 in the nip region N. Therefore, it is not possible to accurately adjust the surface temperature of the fixing belt 103 in the nip region N based on the detected surface temperature of the fixing belt 103.

Moreover, Patent Document 2 discloses a fixing apparatus that detects the surface temperatures of the fixing belt using non-contact temperature sensors, in the region E where the fixing belt 103 is in contact with the hot roller 102 (a region where the fixing belt faces the hot roller, the region being near where the fixing belt starts to wind around the hot roller) and the region G where the fixing belt 103 is in contact with the fixing roller 101 on the downstream side in the revolution direction of the fixing belt 103 (see the arrow in FIG. 11) relative to the nip region N, as shown in FIG. 11.

Also, in the fixing apparatus shown in FIG. 11, the temperatures detected by the non-contact sensors are the temperature on the downstream side in the revolution direction of the fixing belt 103 (see the arrow in FIG. 11) relative to the nip region N, that is, the surface temperature after the revolving fixing belt 103 has passed through the nip region N. Thus, it is not possible to accurately adjust the surface temperature of the fixing belt 103 in the nip region N due to the same reasons as those of the fixing apparatuses shown in FIGS. 9 and 10.

SUMMARY OF THE INVENTION

In view of this, the present invention has been conceived in light of the above conventional problems, and an object thereof is to provide a fixing apparatus capable of accurately adjusting the surface temperature of a fixing belt in a nip region, and an image forming apparatus including this fixing apparatus.

In order to solve the above problems, a fixing apparatus of the present invention includes a hot roller, a fixing roller, a fixing belt that extends between the fixing roller and the hot roller and revolves, and is heated by the hot roller, a pressure roller that is pressed against the fixing roller via the fixing belt, and forms a nip region through which a recording sheet passes between the pressure roller and the fixing belt, at least one non-contact temperature sensor that detects a temperature of the fixing belt, and a control portion that controls a temperature of the hot roller based on the temperature detected by the non-contact temperature sensor, wherein a first temperature detection portion is set in a region where the fixing belt is in contact with a circumferential surface of the hot roller, a second temperature detection portion is set in a region that is on a downstream side in a revolution direction of the fixing belt relative to a separation point at which the fixing belt that has moved along the circumferential surface of the hot roller separates from the circumferential surface of the hot roller, and that is on an upstream side in the revolution direction of the fixing belt relative to the nip region, and the at least one non-contact temperature sensor detects temperatures of the fixing belt at the first temperature detection portion and the second temperature detection portion.

In the fixing apparatus of the present invention, the non-contact temperature sensor detects the temperature of the first temperature detection portion (contact portion) in the region where the fixing belt is in contact with the circumferential surface of the hot roller, and at the same time, detects the temperature of the second temperature detection portion (separation portion) in the region that is on the downstream side in the revolution direction of the fixing belt relative to the separation point at which the fixing belt that has moved along the circumferential surface of the hot roller separates from the circumferential surface of the hot roller, and that is on the upstream side in the revolution direction of the fixing belt relative to the nip region. Specifically, the surface temperature of the fixing belt immediately before reaching the nip region that has separated from the circumferential surface of the hot roller and been influenced by ambient temperature is detected by detecting the temperature of the second detection portion, and the surface temperature of the fixing belt that is in contact with the circumferential surface of the hot roller (which approximately corresponds to the surface temperature of the hot roller) is detected by detecting the temperature of the first detection portion.

Accordingly, in the state where the hot roller, the fixing roller, and the pressure roller are rotating, and the fixing belt is revolving, the temperature of the hot roller can be controlled based on the surface temperature of the fixing belt immediately before reaching the nip region that has separated from the circumferential surface of the hot roller and been influenced by ambient temperature, and thus the surface temperature of the fixing belt in the nip region can be accurately controlled.

In the state where the rotation of the hot roller, the fixing roller, and the pressure roller is stopped, and the revolution of the fixing belt is stopped, the temperature of the hot roller can be controlled based on the surface temperature of the hot roller, and the surface temperature of the hot roller can be maintained at a substantially constant temperature.

In the fixing apparatus according to the present invention, the first temperature detection portion and the second temperature detection portion may be adjacent to each other at the separation point. Specifically, a temperature measurement region of the non-contact temperature sensor may be a region that spans the first temperature detection portion (contact portion) and the second temperature detection portion (separation portion).

In this case, it is possible to detect an average temperature of the temperatures of the first temperature detection portion and the second temperature detection portion using one non-contact temperature sensor. Specifically, it is not necessary to separately provide the fixing apparatus with a non-contact temperature sensor for detecting the temperature of the first temperature detection portion, and a non-contact temperature sensor for detecting the temperature of the second temperature detection portion, and thus the number of components and the cost can be reduced.

In the fixing apparatus of the present invention, the control portion may control the temperature of the hot roller based on a difference between a target temperature and the temperature detected by the non-contact temperature sensor, and may change the target temperature in a state where the fixing belt is caused to revolve and in a state where revolution of the fixing belt is stopped. In this case, the control portion may set the target temperature to a temperature lower than a temperature of the hot roller prescribed in advance, in the state where revolution of the fixing belt is stopped.

For example, in the standby mode, while achieving power saving by stopping the rotation of the hot roller, the fixing roller, and the pressure roller, and stopping the revolution of the fixing belt, it is necessary to maintain the surface temperature of the hot roller at a temperature prescribed in advance, and allow an immediate transition from the standby mode to the operating mode (a mode in which the hot roller, the fixing roller, and the pressure roller are caused to rotate, and the fixing belt is caused to revolve). Heat is favorably conducted from the hot roller to the entire fixing belt in the state (operating mode) where the hot roller, the fixing roller, and the pressure roller are rotating, and the fixing belt is revolving. However, in the state (standby mode) where the rotation of the hot roller, the fixing roller, and the pressure roller is stopped, and the revolution of the fixing belt is stopped, even if heat is conducted from the hot roller to the contact portion of the fixing belt that is in contact with the circumferential surface of the hot roller, heat is not readily conducted to the separation portion of the fixing belt that has separated from the circumferential surface of the hot roller. Accordingly, even if the amounts of heat generated by the hot roller are the same, the temperature of the separation portion of the fixing belt that has separated from the hot roller greatly changes in the state where the fixing belt is revolving and in the state where the revolution of the fixing belt is stopped, and the detection temperature detected by the non-contact temperature sensor also changes. For this reason, the fixing apparatus according to the present invention may adopt a configuration in which, by changing the target temperature used for controlling the temperature of the hot roller in the state where the fixing belt is caused to revolve and in the state where the revolution of the fixing belt is stopped, irrespective of whether or not the fixing belt is revolving, it is possible to maintain the temperature of the hot roller at substantially the same temperature as the temperature prescribed in advance, and allow an immediate transition from the standby mode to the operating mode.

An image forming apparatus of the present invention includes the above fixing apparatus of the present invention. The same functions and effects as those of the above fixing apparatus of the present invention are also achieved in such an image forming apparatus.

DESCRIPTION OF PREFERRED EMBODIMENTS

Below is a detailed description of an embodiment of the present invention, with reference to the accompanying drawings.

Figure 1:
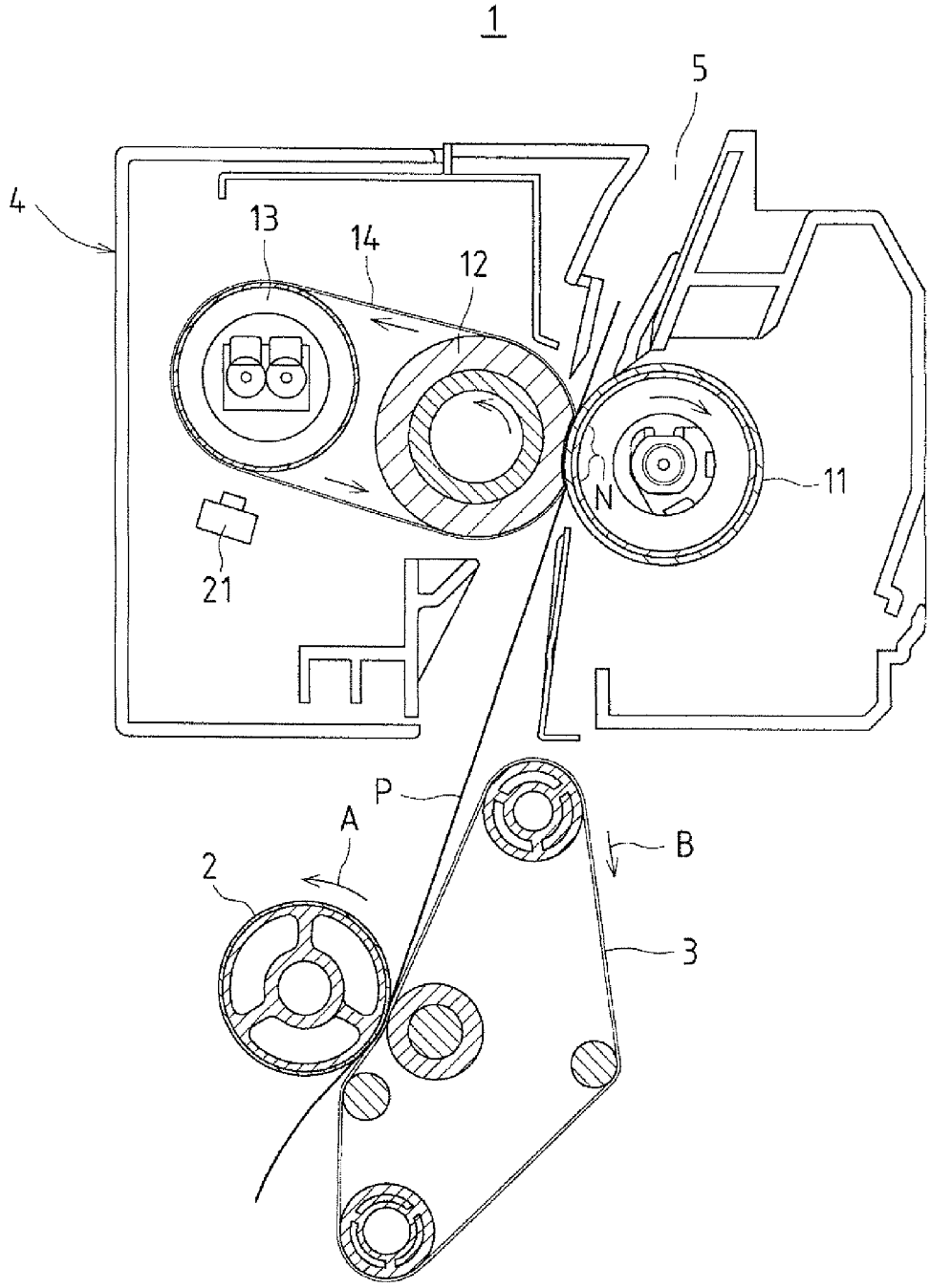
FIG. 1 is a schematic cross-sectional view showing an enlarged principal part of an image forming apparatus according to an embodiment of the present invention.

FIG. 1 is a schematic cross-sectional view showing an enlarged principal part of an image forming apparatus 1 in which an embodiment of a fixing apparatus of the present invention is applied. The image forming apparatus 1 is based on an electrophotographic method, and is provided with a photosensitive drum 2, a transfer belt 3, a fixing apparatus 4, and the like. The photosensitive drum 2 has a photosensitive layer on the surface thereof, and is rotationally driven at a constant rotational speed in the direction of arrow A shown in FIG. 1. In accordance with the rotation of the photosensitive drum 2, the surface of the photosensitive drum 2 is uniformly charged to a predetermined potential by a charging apparatus (not shown). Further, the surface of the photosensitive drum 2 is exposed by an exposing apparatus (not shown), and an electrostatic latent image is thereby formed on the surface of the photosensitive drum 2. The electrostatic latent image on the surface of the photosensitive drum 2 is developed into a toner image by a development apparatus (not shown).

The transfer belt 3 is driven to revolve in the direction of arrow B shown in FIG. 1 at the same speed as the surface speed of the photosensitive drum 2, and is pressed against the photosensitive drum 2. A nip region is formed between the transfer belt 3 and the photosensitive drum 2 as described above. A recording sheet P transported from therebelow is led into this nip region. The toner image on the surface of the photosensitive drum 2 is transferred onto the recording sheet P while the recording sheet P is being transported through this nip region. A high-voltage transfer bias (a high voltage of the opposite polarity (+) to the charge polarity (−) of the toner) is applied to the transfer belt 3 in order to transfer the toner image.

The recording sheet P is transported upward, and led into the fixing apparatus 4, where the toner image on the recording sheet P is fixed by being heated and pressed. The recording sheet P is transported further upward through a transport path 5, and is discharged onto a discharge tray (not shown) or the like.

Figure 2:
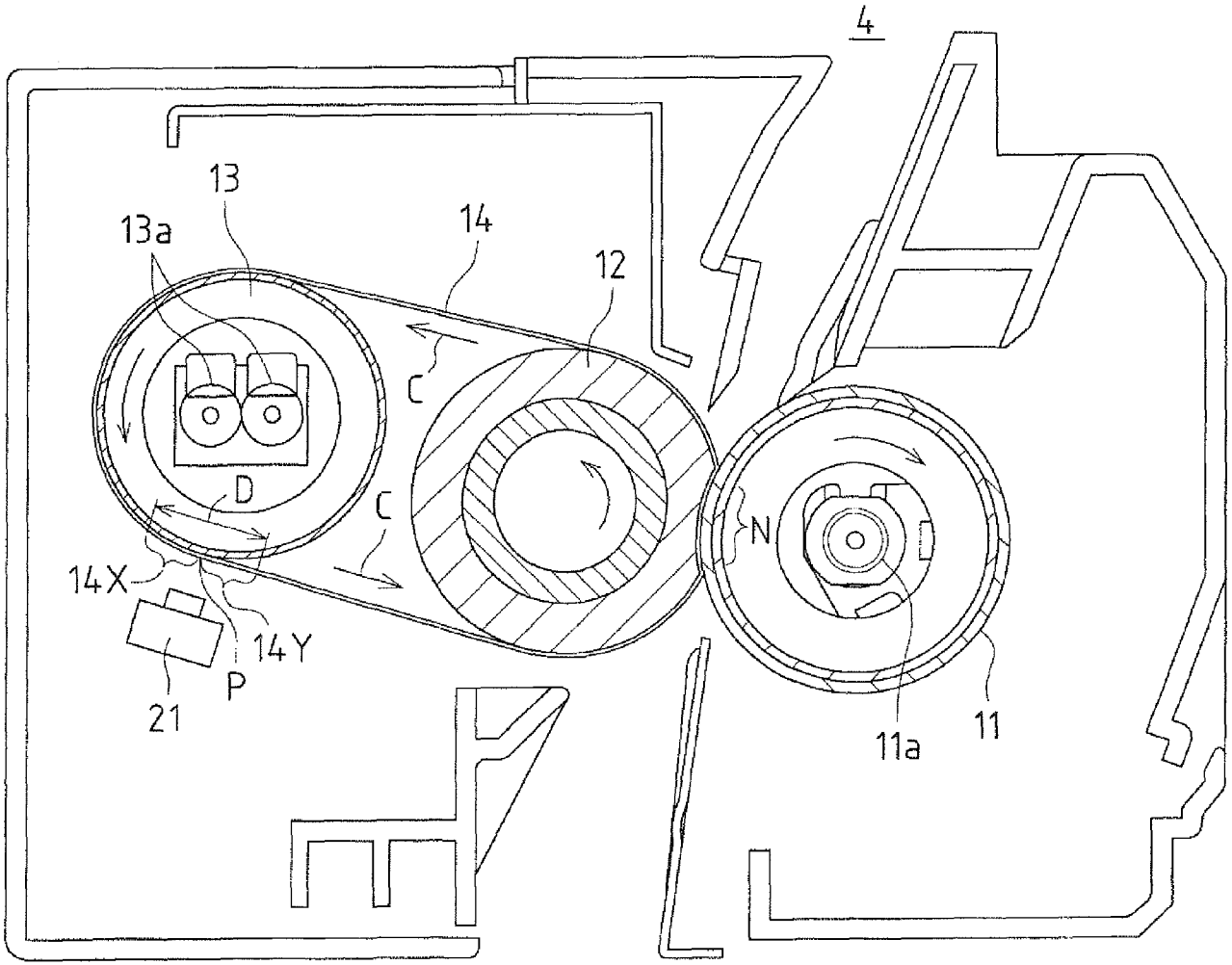
FIG. 2 is a schematic cross-sectional view showing a schematic configuration of a fixing apparatus according to the present embodiment.

FIG. 2 is a schematic cross-sectional view showing a schematic configuration of the fixing apparatus 4 according to the present embodiment. As shown in FIG. 2, the fixing apparatus 4 is provided with a pressure roller 11, a fixing roller 12, a hot roller 13, and an endless fixing belt 14 that extends between the fixing roller 12 and the hot roller 13. The pressure roller is pressed against the fixing roller 12 via the fixing belt 14. Specifically, the pressure roller 11 and the fixing roller 12 are pressed against each other via the fixing belt 14, and a nip region N is formed between the fixing belt 14 and the pressure roller 11.

The pressure roller 11 is a roller having a three-layer structure in which a releasing layer is formed on the outer surface of an elastic layer provided on the outer surface of a hollow shaft. A heater 11*a* (halogen lamp) serving as a heat source that heats the pressure roller 11 is provided inside the pressure roller 11 (inside the hollow shaft).

The fixing roller 12 is a roller in which an elastic layer is provided on the outer surface of a hollow shaft, and the elastic layer is sufficiently thick.

The fixing belt 14 is an endless belt made of a material having favorable heat conduction, and has a releasing layer on the outer circumferential surface thereof.

The hot roller 13 is a roller in which a surface layer is provided on the outer surface of a hollow shaft, and a heater 13*a* (halogen lamp) serving as a heat source that heats the hot roller 13 is provided inside the hot roller 13 (inside the hollow shaft).

Here, the elastic layer of the fixing roller 12 is sufficiently thick, and thus if the pressure roller 11 and the fixing roller 12 are pressed against each other via the fixing belt 14, the elastic layer of the fixing roller 12 is greatly depressed, thereby forming the wide nip region N between the fixing belt 14 and the pressure roller 11. When the rollers (the pressure roller 11, the fixing roller 12, and the hot roller 13) rotate in the respective directions of the arrows shown in FIG. 2, the fixing belt 14 is caused to revolve in the direction of arrow C in FIG. 2 through the nip region N while being heated by the hot roller 13. If a recording sheet is transported through the nip region N in this state, the recording sheet is heated and pressed by the fixing belt 14 and, the pressure roller 11, and a toner image on the recording sheet is thereby fixed.

A non-contact temperature sensor 21 that detects the temperature (specifically, the surface temperature) of the fixing belt 14 is disposed at a location below the fixing belt 14, where the fixing belt 14 starts separating from the surface of the hot roller 13.

If the non-contact temperature sensor 21 is disposed below the fixing belt 14, the length in the horizontal direction of the fixing apparatus 4 is shortened, and thus the fixing apparatus 4 can be reduced in size. Accordingly, it is possible to reduce the size of the image forming apparatus 1 including the fixing apparatus 4.

Assuming that the side in the revolution direction of the fixing belt 14 (see arrow C in FIG. 2) relative to a separation point P at which the fixing belt 14 that has moved along the circumferential surface of the hot roller 13 separates from the circumferential surface of the hot roller 13 is the downstream side, and the side in the reverse direction to the revolution direction of the fixing belt 14 relative to the separation point P is the upstream side, a temperature measurement region D of the non-contact temperature sensor 21 is a region that spans a contact portion 14X of the fixing belt 14 that is in contact with the circumferential surface of the hot roller 13 on the upstream side relative to the separation point P and a separation portion 14Y of the fixing belt 14 that has separated from the hot roller 13 on the downstream side relative to the separation point P. Specifically, the contact portion 14X serving as a first detection portion where the temperature is detected by the non-contact temperature sensor 21 is set in a region where the fixing belt 14 is in contact with the circumferential surface of the hot roller 13. Further, the separation portion 14Y serving as a second temperature detection portion where the temperature is detected by the non-contact temperature sensor 21 is set in a region that is on the downstream side in the revolution direction of the fixing belt 14 relative to the separation point P, and that is on the upstream side in the revolution direction of the fixing belt 14 relative to the nip region N. The contact portion 14X and the separation portion 14Y are adjacent to each other at the separation point P, and the temperature measurement region D is constituted by the contact portion 14X and the separation portion 14Y.

The non-contact temperature sensor 21 detects both the surface temperature of the contact portion 14X of the fixing belt 14 that is in contact with the circumferential surface of the hot roller 13 and the surface temperature of the separation portion 14Y of the fixing belt 14 that has separated from the hot roller 13, and outputs detection output that indicates an intermediate (average) temperature of these surface temperatures (hereinafter, referred to as "detection temperature").

In the contact portion 14X, the fixing belt 14 is in contact with the surface (circumferential surface) of the hot roller 13, and is directly heated by the hot roller 13. Accordingly, the surface temperature of the fixing belt 14 at the contact portion 14X is approximately the same as the surface temperature of the hot roller 13. Further, the surface temperature of the fixing belt 14 at the separation portion 14Y is a temperature influenced by ambient temperature, since the fixing belt 14 is separated from the circumferential surface of the hot roller 13.

The detection output of the non-contact temperature sensor 21 is used to control the heater 13*a* of the hot roller 13. The surface temperature of the hot roller 13 is controlled by controlling the heater 13*a*, and the surface temperature of the fixing belt 14 in the nip region N is thereby adjusted.

Figure 3:
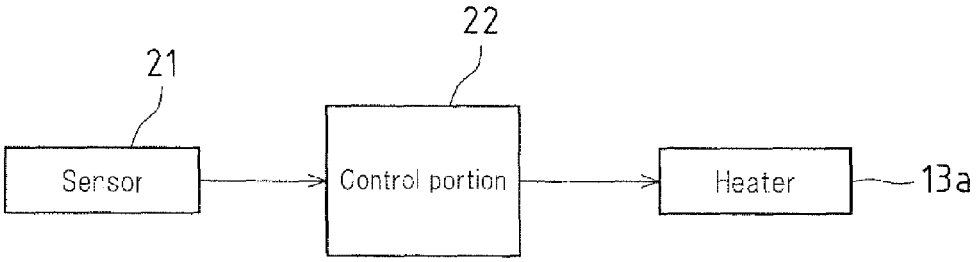
FIG. 3 is a block diagram illustrating a control system of a heater of a hot roller in the fixing apparatus according to the present embodiment.

FIG. 3 is a block diagram illustrating a control system of the heater 13*a* of the hot roller 13 in the fixing apparatus 4 according to the present embodiment. As shown in FIG. 3, a control portion 22 acquires detection output of the non-contact temperature sensor 21, and increases or decreases the amount of heat generated by the heater 13*a* by turning on or off the electrical connection to the heater 13*a* of the hot roller 13 based on the acquired detection output, thereby controlling the surface temperature of the hot roller 13 so as to adjust the surface temperature of the fixing belt 14 in the nip region N, for instance.

The non-contact temperature sensor 21 detects indirectly (in a non-contact manner) the surface temperatures of the fixing belt 14 at the contact portion 14X and the separation portion 14Y The control portion 22 acquires detection output of the non-contact temperature sensor 21, and accurately obtains an intermediate (average) temperature of the surface temperatures of the fixing belt 14 at the contact portion 14X and, the separation portion 14Y (that is, detection temperature) based on the detection output. Based on the detection temperature, the control portion 22 controls on/off of the electrical connection to the heater 13*a* of the hot roller 13, and controls the surface temperature of the hot roller 13, thereby adjusting the surface temperature of the fixing belt 14 in the nip region N, for instance.

Here, the temperature measurement region D of the non-contact temperature sensor 21 is on the upstream side in the revolution direction of the fixing belt 14 (see arrow C in FIG. 2) relative to the nip region N, and the surface temperature of the fixing belt 14 immediately before reaching the nip region N is detected by the non-contact temperature sensor 21. Accordingly, if the surface temperature of the fixing belt 14 is adjusted so as to be a substantially constant fixing temperature by controlling on/off of the heater 13*a* of the hot roller 13 based on this detection temperature, the fixing belt 14 is immediately led into the nip region N while maintaining an approximate fixing temperature.

As described above, the non-contact temperature sensor 21 outputs detection output that indicates an intermediate (average) temperature (detection temperature) of the surface temperature of the contact portion 14X of the fixing belt 14 that is in contact with the circumferential surface of the hot roller 13 (which approximately corresponds to the surface temperature of the hot roller 13) and the surface temperature of the separation portion 14Y of the fixing belt 14 that has separated from the hot roller 13. Specifically, the detection temperature detected by the non-contact temperature sensor 21 is an average temperature of the surface temperature of the hot roller 13 and the surface temperature of the separation portion 14Y of the fixing belt 14 that has separated from the hot roller 13 and been influenced by ambient temperature.

Accordingly, in the state where the hot roller 13, the fixing roller 12, and the pressure roller 11 are rotating, and the fixing belt 14 is revolving, the heater 13*a* of the hot roller 13 is controlled based on the average temperature of the surface temperature of the separation portion 14Y of the fixing belt 14 influenced by ambient temperature and the surface temperature of the contact portion 14Y of the fixing belt 14 (temperature approximately the same as the surface temperature of the hot roller 13). Thus, it is possible to accurately adjust the surface temperature of the fixing belt 14 in the nip region N.

For example, if the surface temperature of the separation portion 14Y of the fixing belt 14 that has separated from the hot roller 13 falls due to ambient temperature, the detection temperature detected by the non-contact temperature sensor 21 also falls. On/off of the electrical connection to the heater 13*a* of the hot roller 13 is controlled according to the fall of the detection temperature, and the surface temperature of the separation portion 14Y of the fixing belt 14 is increased, which enables the surface temperature of the fixing belt 14 in the nip region N to be increased. Further, if the surface temperature of the separation portion 14Y of the fixing belt 14 rises due to ambient temperature, the detection temperature detected by the non-contact temperature sensor 21 also rises.

On/off of the electrical connection to the heater 13*a* of the hot roller 13 is controlled according to the rise of the detection temperature, and the surface temperature of the separation portion 14Y of the fixing belt 14 is decreased, which enables the surface temperature of the fixing belt 14 in the nip region N to be decreased.

Specifically, assuming that a first target temperature set to the same temperature as the fixing temperature prescribed in advance (the temperature of the hot roller when the fixing belt 14 is revolving) is T1, and the detection temperature detected by the non-contact temperature sensor 21 is t1, when (T1−t1) >0, the detection temperature t1 (specifically, the surface temperature of the fixing belt 14 at the separation portion 14Y) has fallen. Thus, a time period during which the heater 13*a* of the hot roller 13 is electrically connected is extended so as to increase the surface temperature of the fixing belt 14 at the separation portion 14Y, thereby increasing the surface temperature of the fixing belt 14 in the nip region N. Further, when (T1−t1)<0, the detection temperature t1 (specifically, the surface temperature of the fixing belt 14 at the separation portion 14Y) has risen. Thus, a time period during which the heater 13*a* of the hot roller 13 is electrically connected is shortened so as to decrease the surface temperature of the fixing belt 14 at the separation portion 14Y, thereby decreasing the surface temperature of the fixing belt 14 in the nip region N.

Figure 4:
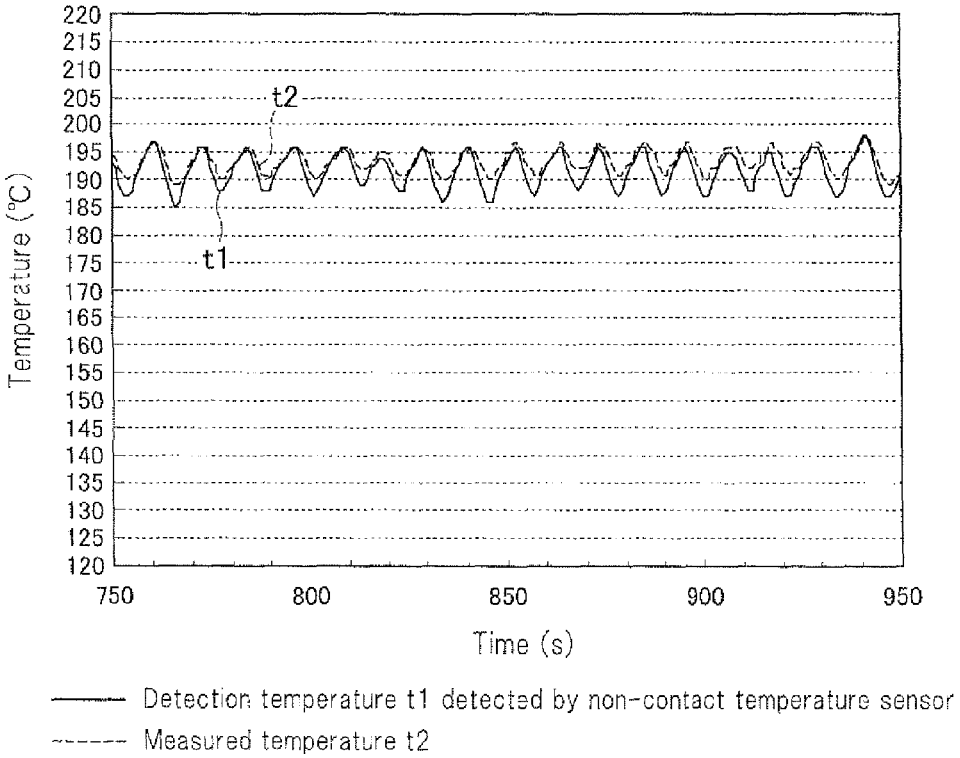
FIG. 4 is a graph showing the detection temperature detected by a non-contact temperature sensor and the measured surface temperature of the hot roller, when the temperature of the hot roller is controlled with a target temperature set to the same temperature as a fixing temperature prescribed in advance in a state where the fixing belt is revolving, in the fixing apparatus according to the present embodiment.

FIG. 4 is a graph showing the detection temperature t1 detected by the non-contact temperature sensor 21 and a measured surface temperature t2 of the hot roller 13, when a time period during which the heater 13*a* of the hot roller 13 is electrically connected is controlled so as to control the temperature of the hot roller in the state where the fixing belt 14 is revolving. As is clear from the graph in FIG. 4, if the detection temperature t1 detected by the non-contact temperature sensor 21 falls, a time period during which the heater 13*a* of the hot roller 13 is electrically connected is extended, and thus the surface temperature t2 of the hot roller 13 rises. Further, if the detection temperature t1 detected by the non-contact temperature sensor 21 rises, a time period during which the heater 13*a* of the hot roller 13 is electrically connected is shortened, and thus the surface temperature t2 of the hot roller 13 falls.

The measured surface temperature t2 of the hot roller 13 tracks the detection temperature t1 detected by the non-contact temperature sensor 21, and approximately corresponds thereto, and thus it can be considered that the surface temperature t2 of the hot roller 13 is controlled based on the detection temperature t1 detected by the non-contact temperature sensor 21.

The detection temperature t1 detected by the non-contact temperature sensor 21 is an average temperature of the surface temperature of the hot roller 13 and the surface temperature of the separation portion 14Y of the fixing belt 14 that has been influenced by ambient temperature as described above, and thus is a temperature slightly lower than the measured surface temperature t2 of the hot roller 13. However, heat is favorably conducted from the hot roller 13 to the entire fixing belt 14 in the state where the fixing belt 14 is revolving, and thus the difference between the detection temperature t1 detected by the non-contact temperature sensor 21 and the surface temperature t2 of the hot roller 13 is slight.

Also, in the state where the rotation of the hot roller 13, the fixing roller 12, and the pressure roller 11 is stopped, and the revolution of the fixing belt 14 is stopped, the control portion 22 controls on/off of the electrical connection to the heater 13*a* of the hot roller 13 based on the detection output of the non-contact temperature sensor 21. Accordingly, the surface temperature of the hot roller 13 is maintained at a substantially constant temperature in the state where the revolution of the fixing belt 14 is stopped.

Specifically, if the surface temperature of the hot roller 13 falls or rises, the surface temperature of the contact portion 14X of the fixing belt 14 that is in contact with the hot roller 13 falls or rises, and thus the detection temperature indicated by the detection output that is output by the non-contact temperature sensor 21 also falls or rises. Accordingly, the surface temperature of the hot roller 13 is adjusted by controlling on/off of the electrical connection to the heater 13*a* of the hot roller 13 according to a change in the detection temperature, thereby maintaining the surface temperature of the hot roller 13 at a substantially constant temperature. For example, in the standby mode, while achieving power saving by stopping the rotation of the hot roller 13, the fixing roller 12, and the pressure roller 11, and stopping the revolution of the fixing belt 14, the surface temperature of the hot roller 13 is maintained at a substantially constant standby temperature, and an immediate transition is allowed from the standby mode to the operating mode.

Specifically, if there is a transition from the state where the fixing belt 14 is revolving (that is, operating mode) to the state where the revolution of the fixing belt 14 is stopped (that is, standby mode), the control portion 22 changes the target temperature used for controlling a time period during which the heater 13*a* of the hot roller 13 is electrically connected from the first target temperature T1 in the state where the fixing belt 14 is revolving to a second target temperature T2 in the state where the revolution of the fixing belt 14 is stopped. Then, assuming that the second target temperature is T2, and the detection temperature detected by the non-contact temperature sensor 21 is t1, when (T2−t1)>0, a time period during which the heater 13*a* of the hot roller 13 is electrically connected is extended so as to increase the surface temperature of the hot roller 13. Further, when (T2−t1)<0, a time period during which the heater 13*a* of the hot roller 13 is electrically connected is shortened so as to decrease the surface temperature of the hot roller 13. Accordingly, the surface temperature of the hot roller 13 is maintained at a substantially constant temperature.

Note that since heat is not readily conducted from the hot roller 13 to the separation portion 14Y of the fixing belt 14 in the state where the revolution of the fixing belt 14 is stopped, the surface temperature of the fixing belt 14 at the separation portion 14Y is much lower, compared with the surface temperature of the fixing belt 14 at the contact portion 14X. Further, the detection temperature t1 detected by the non-contact temperature sensor 21 is an average temperature of the surface temperature of the fixing belt 14 at the separation portion 14Y and the surface temperature of the fixing belt 14 at the contact portion 14X, and thus in the state where the revolution of the fixing belt 14 is stopped, the detection temperature t1 detected by the non-contact temperature sensor 21 is much lower than the surface temperature of the fixing belt 14 at the contact portion 14X, that is, the surface temperature t2 of the hot roller 13. Accordingly, if the same temperature as the standby temperature of the hot roller 13 prescribed in advance (the temperature of the hot roller when the revolution of the fixing belt 14 is stopped) is set as the target temperature T, and a time period during which the heater 13*a* of the hot roller 13 is electrically connected is controlled based on the difference between the target temperature T and the detection temperature t1 (that is, T−t1), the surface temperature t2 of the hot roller 13 will be much higher than the standby temperature prescribed in advance. In view of this, in the state where the revolution of the fixing belt 14 is stopped, the control portion 22 of the fixing apparatus 4 according to the present embodiment sets a temperature lower than the standby temperature prescribed in advance as the second target temperature, and reduces the disparity between the surface temperature t2 of the hot roller 13 and the standby temperature prescribed in advance.

Below is a detailed description of the difference in the surface temperature t2 of the hot roller 13 brought about by the difference of such target temperature setting, with reference to FIGS. 5 and 6.

Figure 5:
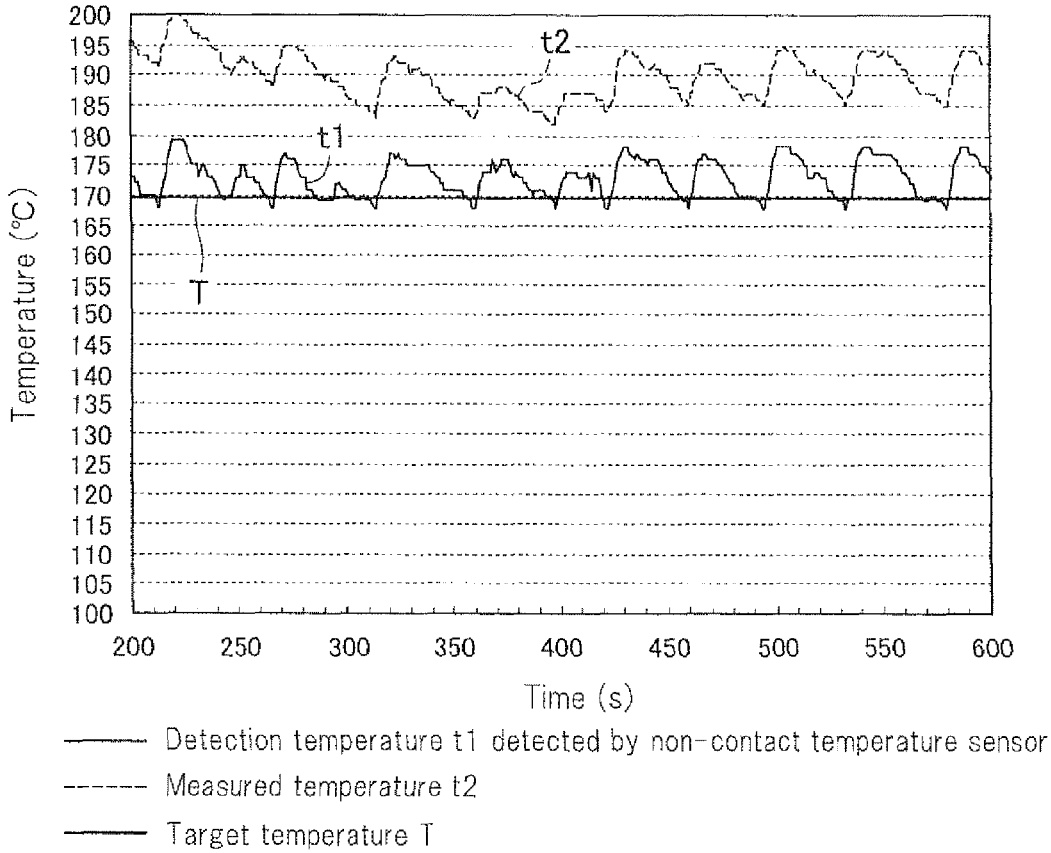
FIG. 5 is a graph showing the detection temperature detected by the non-contact temperature sensor and the measured surface temperature of the hot roller, when the temperature of the hot roller is controlled with the target temperature set to the same temperature as a standby temperature prescribed in advance in a state where the fixing belt is stopped, in the fixing apparatus according to the present embodiment.

FIG. 5 is a graph showing the detection temperature t1 detected by the non-contact temperature sensor 21 and the measured surface temperature t2 of the hot roller 13, when the temperature of the hot roller is controlled with the target temperature T set to the same temperature as the standby temperature of 170° C. prescribed in advance in the state where the fixing belt 14 is stopped. As is clear from the graph in FIG. 5, although the surface temperature t2 of the hot roller 13 changes while tracking the detection temperature t1 detected by the non-contact temperature sensor 21, the detection temperature t1 detected by the non-contact temperature sensor 21 is greatly lower than the surface temperature t2 of the hot roller 13. Thus, the same temperature as the standby temperature prescribed in advance (=170° C.) is set as the target temperature T, and if a time period during which the heater 13*a* of the hot roller 13 is electrically connected is controlled based on the difference between the target temperature T and the detection temperature t1 (that is, T−t1) such that the detection temperature t1 detected by the non-contact temperature sensor 21 equals the target temperature T (=170° C.), the surface temperature t2 of the hot roller 13 will be higher than the standby temperature (=170° C.) prescribed in advance by about 15 to 20° C.

In view of this, in the state where the fixing belt 14 is stopped, the control portion 22 of the fixing apparatus 4 according to the present embodiment sets a temperature lower than the standby temperature prescribed in advance (for example, a temperature lower by 15 to 20° C.) as the second target temperature T2, and a time period during which the heater 13*a* of the hot roller 13 is electrically connected is controlled, thereby controlling the surface temperature t2 of the hot roller 13. In this way, as shown in FIG. 6, the disparity between the surface temperature t2 of the hot roller 13 and the standby temperature prescribed in advance (=170° C.) is reduced.

Figure 6:
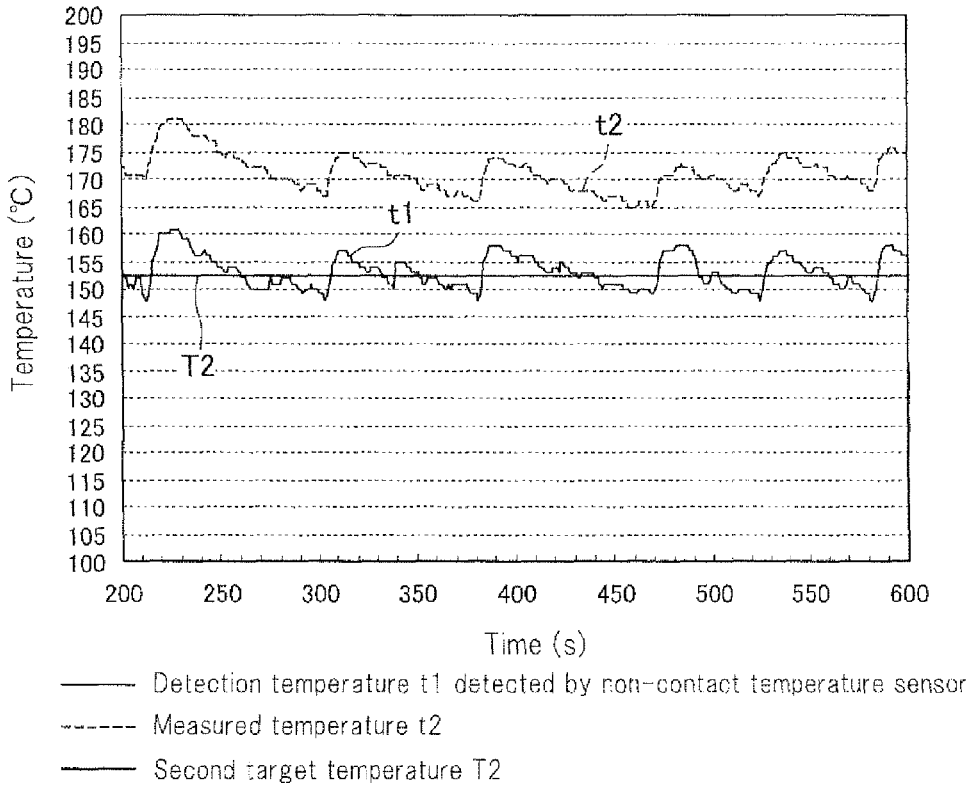
FIG. 6 is a graph showing the detection temperature detected by the non-contact temperature sensor and the measured surface temperature of the hot roller, when the temperature of the hot roller is controlled with the target temperature set to a temperature lower than the standby temperature prescribed in advance in a state where the fixing belt is stopped.

FIG. 6 is a graph showing the detection temperature t1 detected by the non-contact temperature sensor 21 and the measured surface temperature t2 of the hot roller 13, when the temperature of the hot roller is controlled with the second target temperature T2 set to 152.5° C., which is lower than the standby temperature prescribed in advance (=170° C.) by 17.5° C., in the state where the fixing belt 14 is stopped. As is clear from the graph in FIG. 6, if a time period during which the heater 13*a* of the hot roller 13 is electrically connected is controlled such that the detection temperature t1 detected by the non-contact temperature sensor 21 equals the second target temperature T2 (=152.5° C.), the surface temperature t2 of the hot roller 13 will be about 170° C., which is higher than the second target temperature T2 (=152.5° C.) by 15 to 20° C. The surface temperature t2 (=170° C.) of the hot roller 13 is the same as the standby temperature prescribed in advance (=170° C.).

Thus, the control portion 22 of the fixing apparatus 4 according to the present embodiment changes the target temperature used for controlling the temperature of the hot roller 13 in the state where the revolution of the fixing belt 14 is stopped and in the state where the fixing belt 14 is caused to revolve. Also, in the state where the revolution of the fixing belt 14 is stopped, the control portion 22 sets the target temperature to a temperature lower than the surface temperature (standby temperature) of the hot roller 13 prescribed in advance, thereby controlling the surface temperature of the hot roller 13 to be at the temperature prescribed in advance.

Note that the standby temperature prescribed in advance as the surface temperature of the hot roller 13 when the revolution of the fixing belt 14 is stopped may be the same temperature as a fixing temperature prescribed in advance as the surface temperature of the hot roller 13 when the fixing belt 14 is caused to revolve or may be a different temperature therefrom.

Also, in the case where the fixing temperature is the same temperature as the standby temperature, in the state where the revolution of the fixing belt 14 is stopped, the target temperature (the second target temperature) used for controlling the temperature of the hot roller 13 is set to a temperature lower than the standby temperature as described above. Accordingly, the target temperature used for controlling the temperature of the hot roller 13 is changed in the state where the revolution of the fixing belt 14 is stopped and in the state where the fixing belt 14 is caused to revolve, and by performing such target temperature change, the surface temperature of the hot roller can be maintained at substantially the same temperature, irrespective of whether or not the fixing belt 14 is revolving.

When the fixing belt 14 is revolving, the control portion 22 of the fixing apparatus 4 according to the present embodiment sets the first target temperature T1 to the same temperature as the fixing temperature prescribed in advance, and controls the temperature of the hot roller 13 according to the difference between the first target temperature T1 and the detection temperature t1, as described above. According to such control, the surface temperature t2 of the hot roller 13 will be slightly higher than the fixing temperature prescribed in advance. The slight difference between the surface temperature t2 of the hot roller 13 and the fixing temperature prescribed in advance can be eliminated by controlling the temperature of the hot roller with the first target temperature T1 being set to a temperature slightly lower than the fixing temperature prescribed in advance (a temperature lower by 0° C. to several degrees Celsius such as 2° C. or 3° C.). However, as shown in FIG. 4, there is a very slight temperature difference between the detection temperature t1 and the surface temperature t2 of the hot roller 13 in the state where the fixing belt 14 is revolving, and the difference is extremely small, compared with the temperature difference between the detection temperature t1 and the surface temperature t2 of the hot roller 13 in the state where the revolution of the fixing belt 14 is stopped (see FIGS. 5 and 6). Accordingly, in the state where the fixing belt 14 is revolving, the surface temperature t2 of the hot roller 13 is maintained at substantially the same temperature as the fixing temperature prescribed in advance even if the temperature of the hot roller 13 is controlled with the first target temperature T1 set to the same temperature as the fixing temperature prescribed in advance.

Figure 7:
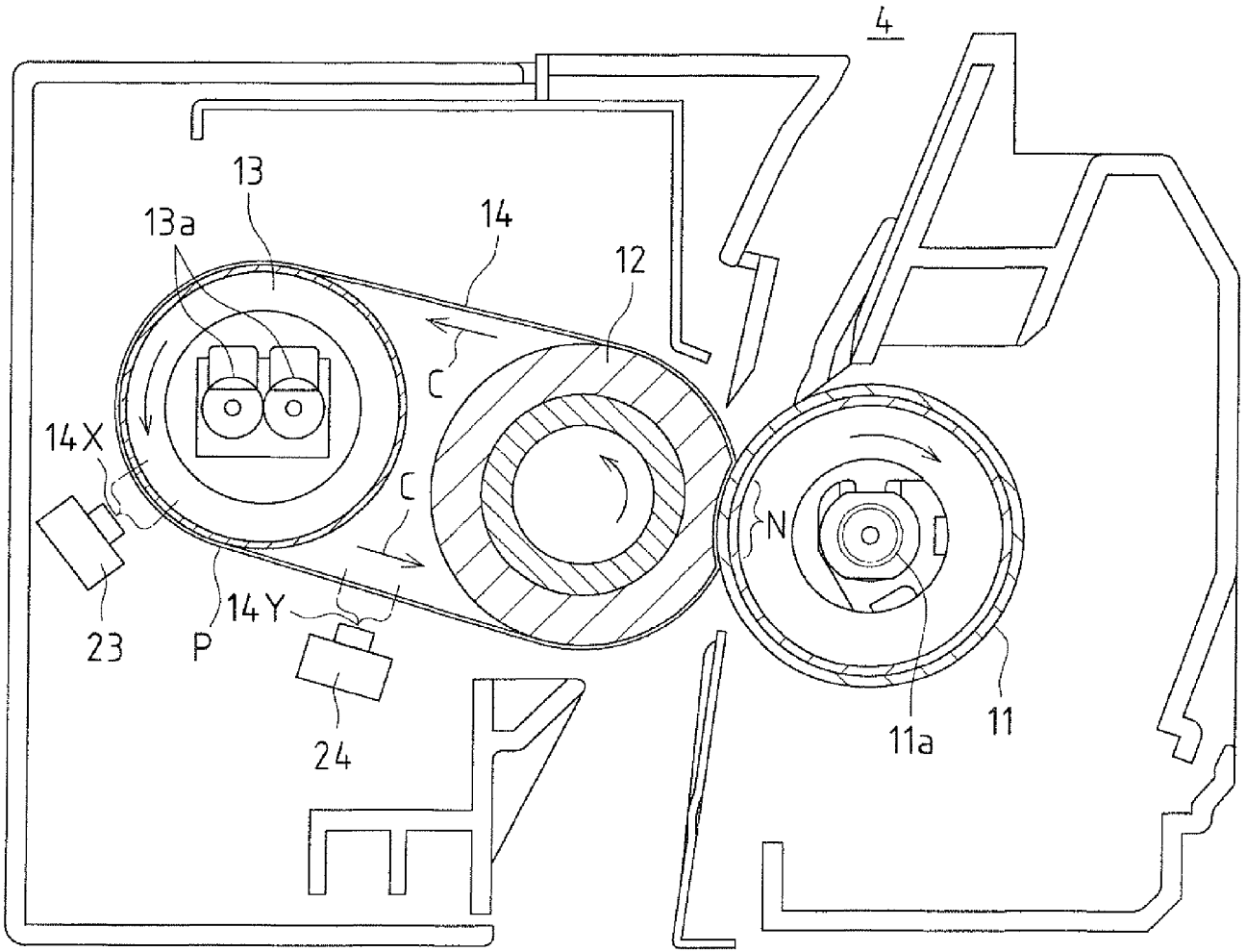
FIG. 7 is a schematic cross-sectional view showing a schematic configuration of a fixing apparatus according to another embodiment.
Figure 8:
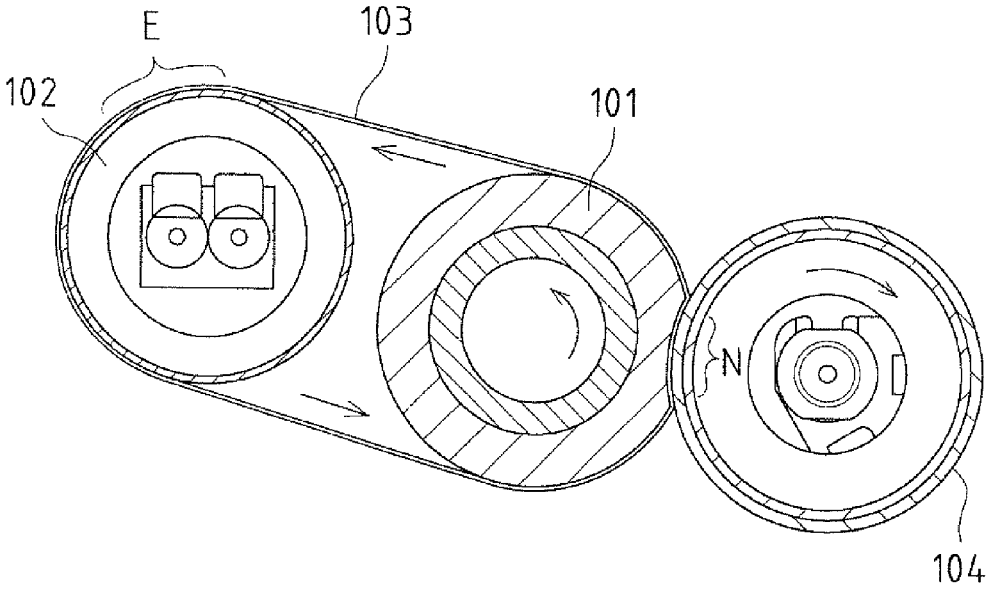
FIG.8 Prior Art
FIG. 8 is a schematic cross-sectional view showing a schematic configuration of a conventional fixing apparatus.
Figure 9:
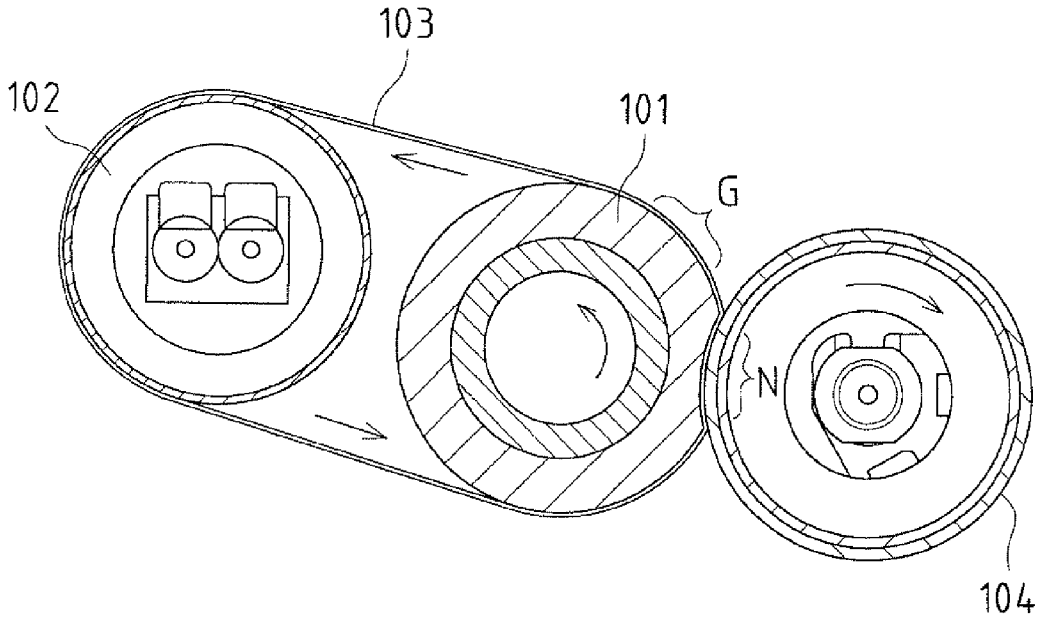
FIG.9 Prior Art
FIG. 9 is a schematic cross-sectional view showing a schematic configuration of a conventional fixing apparatus.
Figure 10:
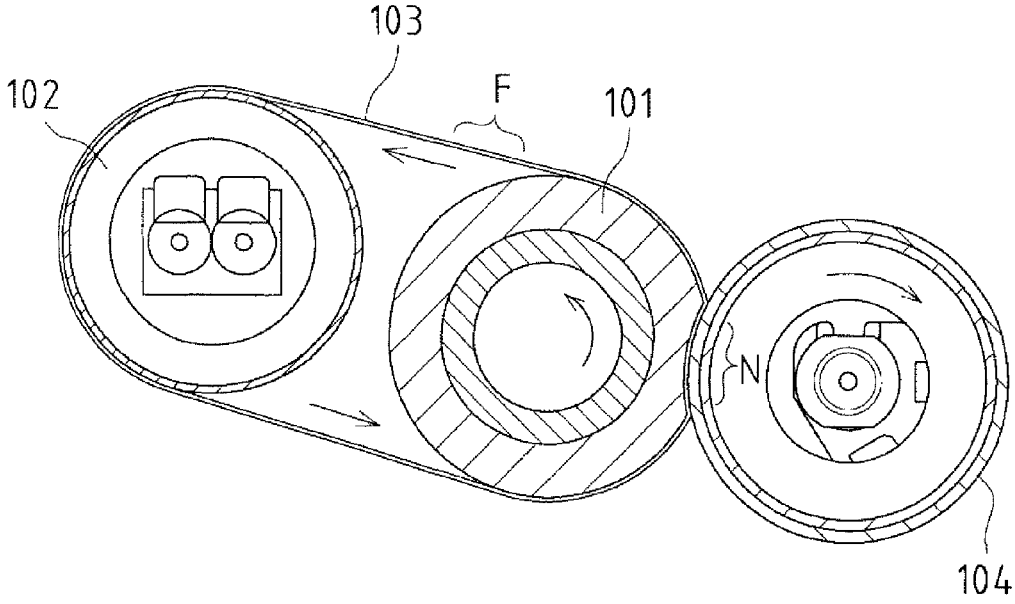
FIG.10 Prior Art
FIG. 10 is a schematic cross-sectional view showing a schematic configuration of a conventional fixing apparatus.
Figure 11:
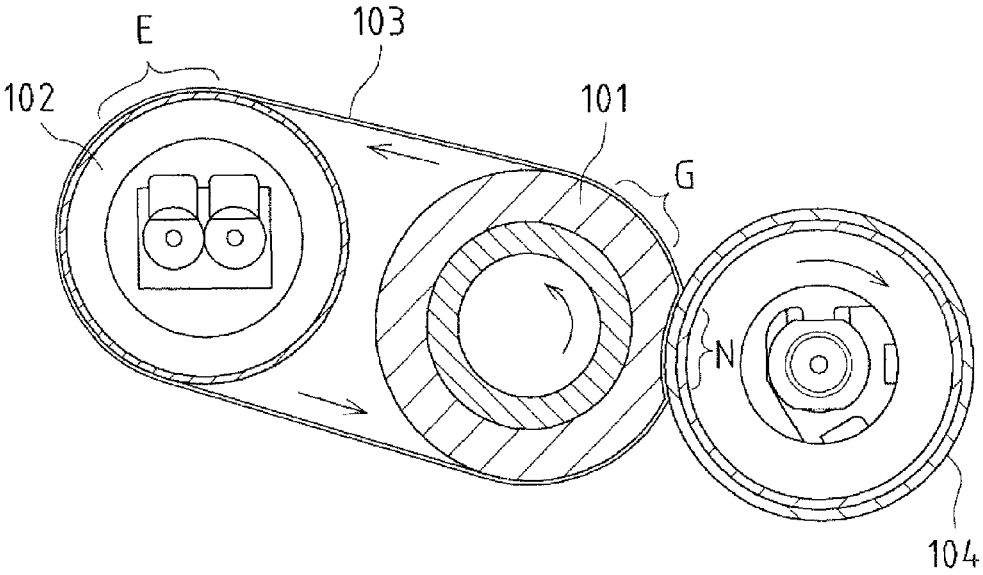
FIG.11 Prior Art
FIG. 11 is a schematic cross-sectional view showing a schematic configuration of a conventional fixing apparatus.

In another embodiment of the present invention, two non-contact temperature sensors 23 and 24 may be provided as shown in. FIG. 7. In the other embodiment shown in FIG. 7, the contact portion 14X (first temperature detection portion) and the separation portion 14Y (second temperature detection portion) are disposed so as to be separated from each other, with the one non-contact temperature sensor 23 detecting the temperature of the fixing belt 14 at the contact portion 14X, and the other non-contact temperature sensor 24 detecting the temperature of the fixing belt 14 at the separation portion 14Y.

The control portion 22 acquires the detection output of both of the non-contact temperature sensors 23 and 24, and obtains an average temperature (that is, detection temperature) of the surface temperatures of the fixing belt 14 at the contact portion 14X and, the separation portion 14Y based on the detection output. Based on the detection temperature, the control portion 22 controls the surface temperature of the hot roller 13 by controlling on/off of the electrical connection to the heater 13*a* of the hot roller 13, thereby adjusting the surface temperature of the fixing belt 14 in the nip region N, for instance. The same effects as those of the embodiment of the present invention are also achieved in this other embodiment of the present invention.

The present invention may be embodied in various other forms without departing from the spirit or essential characteristics thereof. The embodiments disclosed in this application are to be considered in all respects as illustrative and not limiting. The scope of the invention is indicated by the appended claims rather than by the foregoing description. All variations and modifications falling within the equivalency range of the appended claims are intended to be embraced therein.

DESCRIPTION OF REFERENCE NUMERALS

1 Image forming apparatus
2 Photosensitive drum
3 Transfer belt
4 Fixing apparatus
11 Pressure roller
12 Fixing roller
13 Hot roller
14 Fixing belt
14X Contact portion (First temperature detection portion)
14Y Separation portion (second temperature detection portion)
21, 23, 24 Non-contact temperature sensor
22 Control portion

What is claimed is:

1. A fixing apparatus, comprising:
a hot roller;
a fixing roller;
a fixing belt that extends between the fixing roller and the hot roller and revolves, and is heated by the hot roller;
a pressure roller that is pressed against the fixing roller via the fixing belt, and forms a nip region through which a recording sheet passes between the pressure roller and the fixing belt;
at least one non-contact temperature sensor that detects a temperature of the fixing belt; and
a control portion that controls a temperature of the hot roller based on the temperature detected by the non-contact temperature sensor,
wherein a first temperature detection portion is set in a region where the fixing belt is in contact with a circumferential surface of the hot roller,
a second temperature detection portion is set in a region that is on a downstream side in a revolution direction of the fixing belt relative to a separation point at which the fixing belt that has moved along the circumferential surface of the hot roller separates from the circumferential surface of the hot roller, and that is on an upstream side in the revolution direction of the fixing belt relative to the nip region,
the at least one non-contact temperature sensor detects temperatures of the fixing belt at the first temperature detection portion and the second temperature detection portion; and
wherein the first temperature detection portion and the second temperature detection portion are adjacent to each other at the separation point.

2. The fixing apparatus according to claim 1, wherein the control portion controls the temperature of the hot roller based on a difference between a target temperature and the temperature detected by the non-contact temperature sensor, and changes the target temperature in a state where the fixing belt is caused to revolve and in a state where revolution of the fixing belt is stopped.

3. The fixing apparatus according to claim 2, wherein the control portion sets the target temperature to a temperature lower than a temperature of the hot roller prescribed in advance, in the state where revolution of the fixing belt is stopped.

4. An image forming apparatus comprising the fixing apparatus according to claim 1.

5. A fixing apparatus, comprising:
a hot member;
a fixing member;
a fixing belt that extends between the fixing member and the hot member and revolves, and is heated by the hot member;
a pressure member that is pressed against the fixing member via the fixing belt, and forms a nip region through which a recording sheet passes between the pressure member and the fixing belt;
at least one non-contact temperature sensor that detects a temperature of the fixing belt; and
a control portion that controls a temperature of the hot member based on the temperature detected by the non-contact temperature sensor,
wherein a first temperature detection portion is set in a region where the fixing belt is in contact with a circumferential surface of the hot member,
a second temperature detection portion is set in a region that is on a downstream side in a revolution direction of the fixing belt relative to a separation point at which the fixing belt that has moved along the circumferential surface of the hot member separates from the circumferential surface of the hot member, and that is on an upstream side in the revolution direction of the fixing belt relative to the nip region,
the at least one non-contact temperature sensor detects temperatures of the fixing belt at the first temperature detection portion and the second temperature detection portion, and
wherein the first temperature detection portion and the second temperature detection portion are adjacent to each other at the separation point.

* * * * *